US006497396B1

(12) United States Patent
Adams

(10) Patent No.: US 6,497,396 B1
(45) Date of Patent: Dec. 24, 2002

(54) FASTENING DEVICE

(75) Inventor: William E. Adams, Portersville, PA (US)

(73) Assignee: Adams Manufacturing Corp., Portersville, PA (US)

( * ) Notice: Subject to any disclaimer, the term of this patent is extended or adjusted under 35 U.S.C. 154(b) by 0 days.

(21) Appl. No.: 09/718,282

(22) Filed: Nov. 22, 2000

(51) Int. Cl.[7] ..... F16B 45/00; A47G 1/16; E04G 3/00; A47F 5/08

(52) U.S. Cl. ..... 248/304; 248/205.1; 248/231.91; 248/489

(58) Field of Search ..... 248/304, 690, 248/470, 489, 205.1, 217.3, 303, 231.91, 231.31; 411/60.1

(56) References Cited

U.S. PATENT DOCUMENTS

| | | | |
|---|---|---|---|
| 2,471,584 | A | 5/1949 | Richards |
| 3,268,195 | A | 8/1966 | Hoffman |
| 3,768,767 | A | 10/1973 | Dobkowski |
| 4,145,840 | A | 3/1979 | Davidson |
| 4,337,915 | A | 7/1982 | Cali |
| 4,771,974 | A | 9/1988 | Carlson |
| 5,022,623 | A | 6/1991 | Laarman |
| 5,560,574 | A | 10/1996 | Vanderploeg |

*Primary Examiner*—Ramon O. Ramirez
*Assistant Examiner*—Amy J. Sterling
(74) *Attorney, Agent, or Firm*—Kirkpatrick & Lockhart LLP

(57) ABSTRACT

A fastening device for supporting various objects on a brick wall, block wall, tile wall or a wall having grooves therein, wherein the fastening device may comprise a clip member and a mounting member, wherein the clip member has a first arm portion, a second arm portion, an intermediate portion and a biasing mechanism, and wherein the mounting member extends downward from the clip member and may take the form of an S-shaped hook member. Alternatively, the mounting member may include a cam member. The fastening device may also be provided with a plurality of tangs on the exterior of the clip member and a living hinge that connects the first and second arm portions of the clip member. To accommodate different sizes of mortar joints the clip member may include a notch that allows for the alteration of the clip member to fit within different sizes of mortar joints. Another embodiment may include a second mounting member.

8 Claims, 11 Drawing Sheets

FASTENING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to a fastening device, and more specifically to a fastening device for supporting various sized objects along a brick or block wall having a spring-action clip member and a mounting device.

2. Description of the Invention Background

Some conventional fastening devices comprise a clip and a retainer, wherein the clip has two flat legs extending outward from a bend in an untensioned state. To install the clip within a mortar joint, the legs are forced together, the clip is positioned between two adjacent bricks and received within a mortar joint, and the legs are released such that the free ends of the legs engage the adjacent bricks. The disadvantage of this type of conventional fastening device is that it is made to hold only lightweight objects such as plants and vines along a brick wall and is not able to support heavier objects such as pictures and wreaths.

Another conventional type fastening device comprises two spring biased arms and a hook member, wherein the arms extend horizontally from the hook member and are received within the horizontal mortar joint, and the hook member is also received within the vertical mortar joint. To install this type of fastening device, the arms are compressed such that they can fit within the horizontal mortar joint. Once within the horizontal mortar joint, the arms are released resulting in the arms engaging the adjacent bricks. The disadvantage of this type of fastening device is that the fastening means cannot be used with various sizes of mortar joints in that if the bricks are spaced too close together the hook member and the arms will not fit within the mortar joint.

None of the prior art teaches or suggests a fastening device that can support objects having various sizes and weights along a brick wall without being easily disengaged from the brick wall and a device that may be used with various sizes of mortar joints to support objects along a brick wall.

Accordingly, the need exists for a fastening device that can support objects having various sizes and weights along a wall having grooves without being easily disengaged from the wall.

There is also a need for a fastening device that may be used with various sizes of mortar joints to support objects along a wall having grooves.

SUMMARY OF THE PRESENT INVENTION

The present invention provides a fastening device for stablely supporting various sizes of objects along a wall having grooves, wherein the brick wall and mortar joints may be of various sizes and shapes.

The present invention further provides a fastening device having a clip member including a first arm portion, a second arm portion, an intermediate portion, and a biasing mechanism, and a mounting member that extends downwardly from the clip member such that when an object is attached to the mounting member the weight of the object increases the friction between the first and second arm portions and the structure to which the device is attached. The clip member may be concave and have tangs extending from the exterior portion thereof.

The present invention further provides for the clip member having notches such that the clip member can be altered to fit within various sizes of mortar joints.

The present invention provides for the mounting member to take many forms such as, for example, a hook member having an S-shaped portion.

The present invention further provides a fastening device having an engagement member including a first arm portion, a second arm portion, and an intermediate portion wherein the intermediate portion is a living hinge that allows for the first arm portion to frictionally engage the mortar joint. The fastening device of the present invention may be made from plastic; however, suitable metals may also be used.

The present invention further provides a fastening device having a clip member including a first arm portion, a second arm portion, an intermediate portion, and a biasing mechanism, and a mounting member including a cam body, wherein the cam is received within the clip member and when rotated forces the first arm portion and the second arm portion into frictional engagement with adjacent bricks of the brick wall. The cam may be non-circular, for example, the cam may be oblong having a plurality of slots.

Other details, objects and advantages of the present invention will become more apparent with the following description of the present invention.

BRIEF DESCRIPTION OF THE DRAWINGS

For the present invention to be readily understood and practiced, preferred embodiments will described in conjunction with the following figures wherein.

DETAILED DESCRIPTION OF THE INVENTION

The present invention will be described below in terms of a fastening device for supporting objects along a wall having grooves. It should be noted that describing the present invention in terms of a fastening device for supporting objects along a wall having a groove, such as a brick wall is for illustrative purposes only and the advantages of the present invention may be realized using other structures and technologies.

Figure 1:
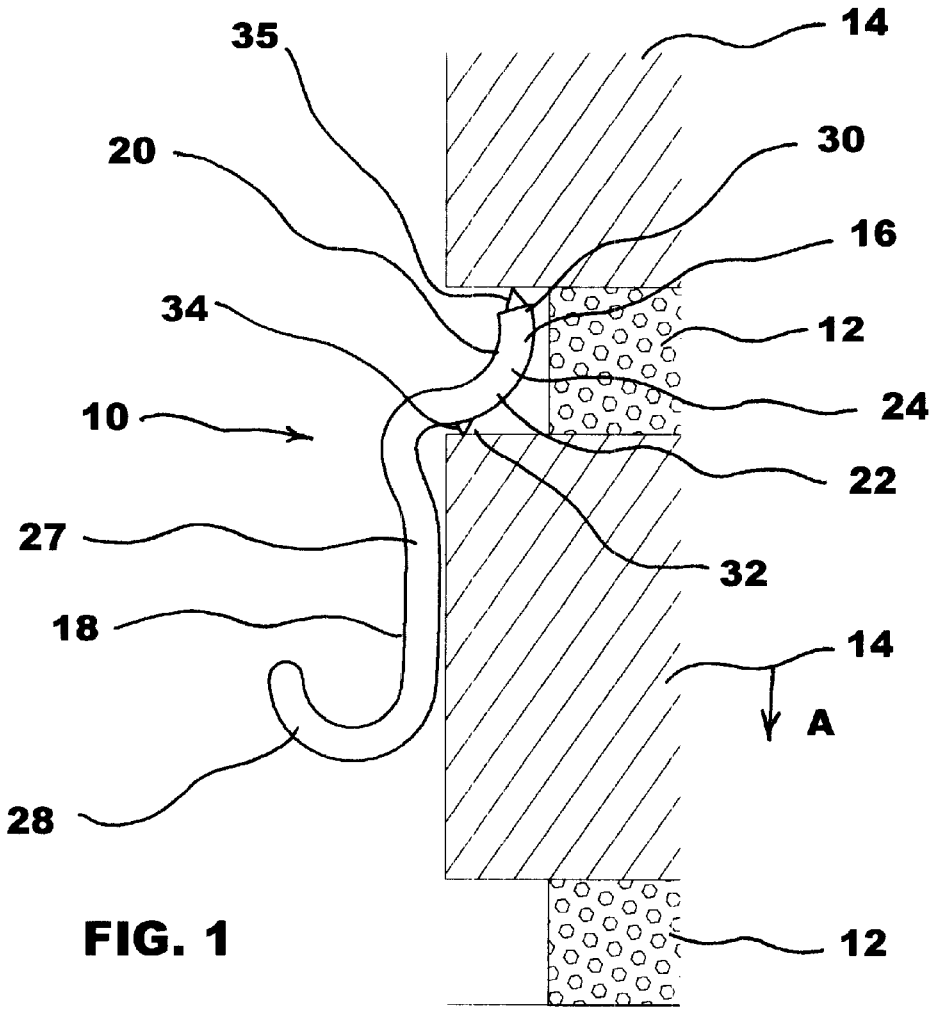
FIG. 1 is a side view of the fastening device of the present invention, wherein the fastening device is shown engaging a mortar joint between two bricks.

Referring to FIG. 1, wherein like reference numbers refer to similar parts throughout the several views, FIG. 1 is a side view of the fastening device 10 of the present invention, wherein the fastening device 10 is shown engaging a mortar joint 12 between two bricks 14. The fastening device 10 comprises a clip member 16 and a mounting member 18. The clip member 16 comprises a first arm portion 20, a second arm portion 22, and an intermediate spring portion 24 having a biasing mechanism, wherein the first arm portion 20, the second arm portion 22 and the intermediate portion 24 form a curvi-linear member. Engagement portions 30 and 32 are formed on the clip member 16 as tangs 34 and 35 which engage the lower and upper bricks 14, respectively, and are urged into engagement with the mortar joint 12 and bricks 14 and/or blocks by the spring action of intermediate portion 24 of the clip member 16. The mounting member 18 can take the form of a hook member 28 and an elongated portion 27 that extends in the downward direction A proximate the brick wall 14. The fastening device 10 is plastic, but the fastening device 10 may also be made from suitable metals.

To attach the fastening device 10 to a brick wall, the free ends of the first arm portion 20 and the second arm portion 22 are forced together, such that the clip member 16 is transformed from a relaxed state to a tensioned state and the clip member 16 in this tensioned state is inserted within the mortar joint 12 between two adjacent bricks 14. Then the first and second arm portions are released such that the free ends of the first and second arm portions 20 and 22 engage the adjacent bricks 14. The desired object (not shown) is then hung on the hook member 28. The object's weight on the hook member 28 creates a downward force driving the second arm portion 22 and tangs 34 into the lower brick 14 and first arm portion 20 into the upper brick 14. The fastening device 10 can be used to support a variety of objects along the wall.

Figure 2:
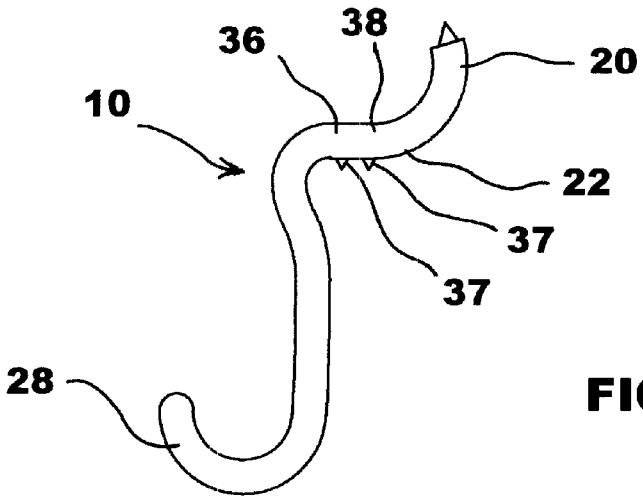
FIG. 2 is a side view of another embodiment of the fastening device of the present invention having multiple tangs.

FIG. 2 is a side view of another embodiment of the fastening device 10 of the present invention having multiple tangs 37 on the second arm portion 22. To alleviate the problem associated with varying mortar depths between bricks 14 and/or blocks, the tangs 37 may be provided in one of two locations 36 or 38 along the second arm portion 22 as well as a variety of other location on the fastening device 10. In a shallow joint location 38 would be operative and the tang 37 would engage the mortar joint 12 and/or brick 14, while in deeper joints, location 36 would be operative and the tang 37 would engage the mortar joint 12 and/or the brick 14.

Figure 3:
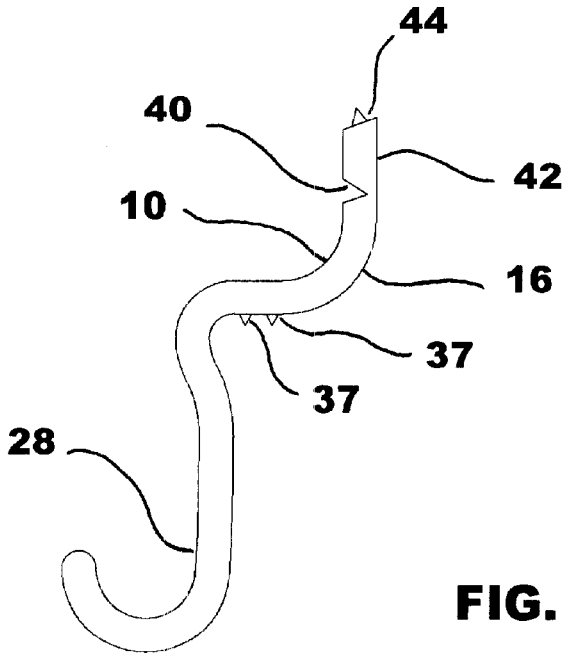
FIG. 3 is a side view of another embodiment of the fastening device of the present invention having a notch wherein the mounting member has an S-shaped portion.

FIG. 3 is a side view of another embodiment of the fastening device 60 of the present invention having a notch 40, wherein the notch 40 may be provided along the clip member 16 to, in essence, vary the location of upper engagement point 42 or 44 of the second arm portion 22 such that they would engage the mortar joint 12 and/or brick 14. Thus, in order for the upper engagement point 44 to engage the mortar joint 12 and/or brick 14, no action is necessary. However, if the mortar joint 14 is shorter and engagement point 42 is to be used, the plastic is snapped off at the notch 40 and upper engagement point 42 engages the mortar joint 12 and/or the upper brick 14.

Figure 4:
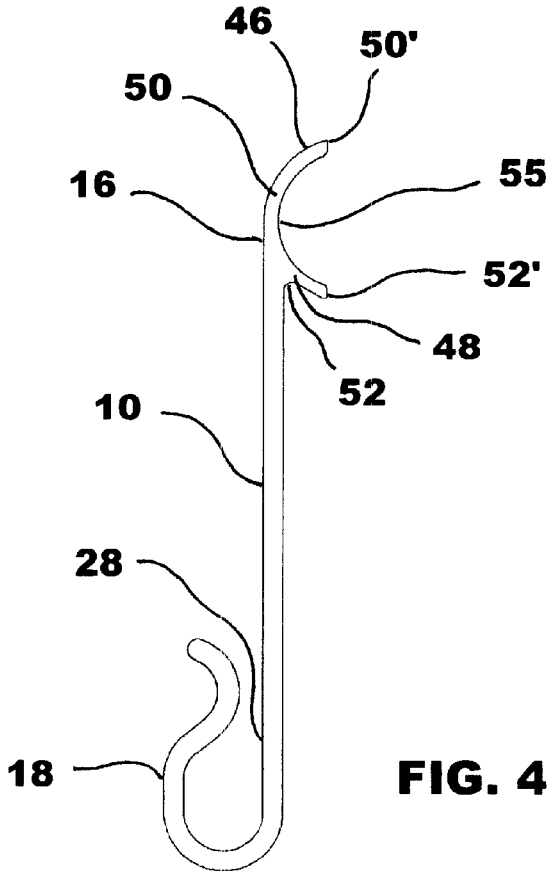
FIG. 4 is a side view of another embodiment of the fastening device of the present invention.

FIG. 4 is a side view of another embodiment of the fastening device 10 of the present invention. The clip member 16 of this embodiment comprises a first arm portion 50 having a gripper 46, a second arm portion 52 having a gripper 48, an intermediate spring portion 55 that is concave and has a biasing mechanism. The mounting member 18 may be an S-shaped hook member 28 that is spring biased. This embodiment points the grippers 46 and 48 into the mortar joint 12 and/or brick 14 resulting in engagement points 50' and 52' of the grippers 46 and 48, respectively, engaging the mortar joint 12 and/or the brick 14 while the gripper 46 forces the gripper 48 into the lower brick 14.

Figure 5:
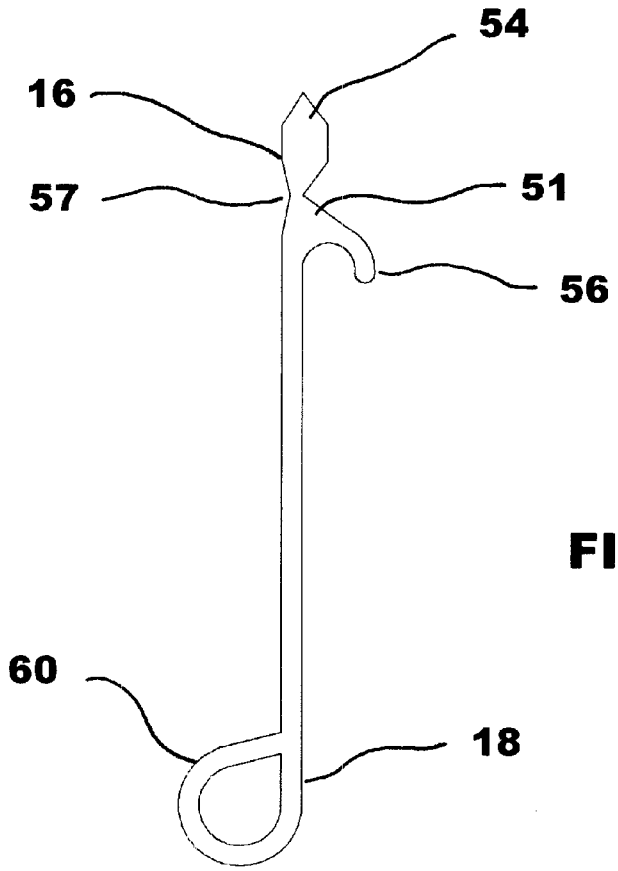
FIG. 5 is a side view of yet another embodiment of the fastening device of the present invention having a living hinge.

FIG. 5 is a side view of yet another embodiment of the fastening device 10 of the present invention having a living hinge 57 and a closed-loop mounting member 60. The fastening device 10 comprises a clip member 16 and a mounting member 18. The clip member 16 further comprises an upper member 54, a lower member 51, a living hinge 57 connecting the upper member 54 and the lower member 51, and an engagement member 56 which may take the form of a hook. The living hinge 57 provides for the upper member 54 to pivot about the living hinge 57. Thus, the upper member 54 may be pivoted about the living hinge 57 and then positioned within the mortar joint 12 where the upper member 54 is released. The upper member 54 then engages the mortar joint 12 and/or the bricks 14. Also, engagement member 56 engages the lower brick member 14. As such, it is the movement of upper member 54 to the right or the left about living hinge 57 that forces the engagement member 56 into the lower brick 14. The closed-loop mounting member 60 supports objects (not shown). For example, objects may be threaded through the closed-loop mounting member 60.

Figure 6:
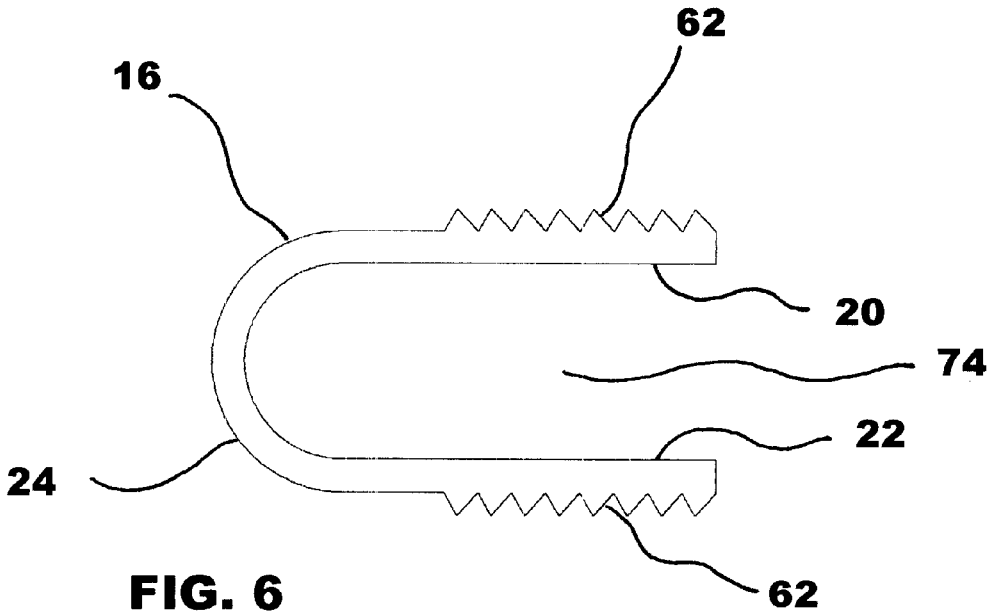
FIG. 6 is a side view of another embodiment of the fastening device of the present invention.
Figure 7:
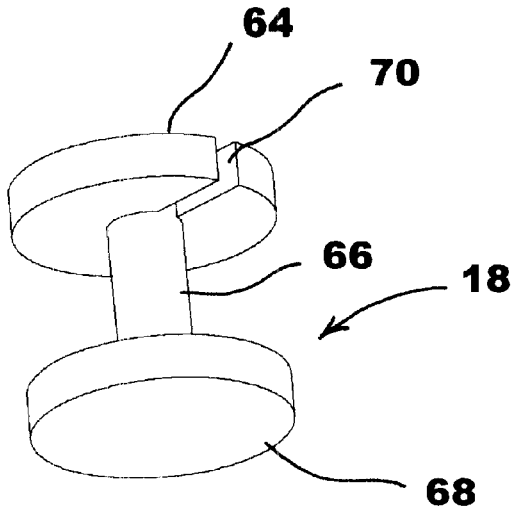
FIG. 7 is a perspective view of a cam member of the fastening device of the present invention shown in FIG. 6.

Referring to FIGS. 6 and 7, FIG. 6 is a side view of another embodiment of the fastening device 10 of the present invention that includes a cam member 64 shown in FIG. 7. The fastening device 10 comprises a clip member 16, shown in FIG. 6, and a mounting member 18, shown in FIG. 7. The clip member 16 further comprises a first arm portion 20, a second arm portion 22, and an intermediate spring portion 24 having a biasing mechanism. The first arm portion 20, the second arm portion 22 and the intermediate spring portion 24 substantially form a U-shaped member defining a cavity 74. The first arm portion 20 and the second arm portion 22 have serrated surfaces 62 As shown in FIG. 7, the mounting member 18 further comprises a cam member 64, a rod member 66 and a stop 68, wherein the cam member 64 may be non-circular shaped such as, for example, oblong, and the cam member 64 may have at least one slot 70. Although not shown, the cam member 64 may have any number of slots 70. Also, the stop member 68 may take a variety of forms.

Figure 8A:
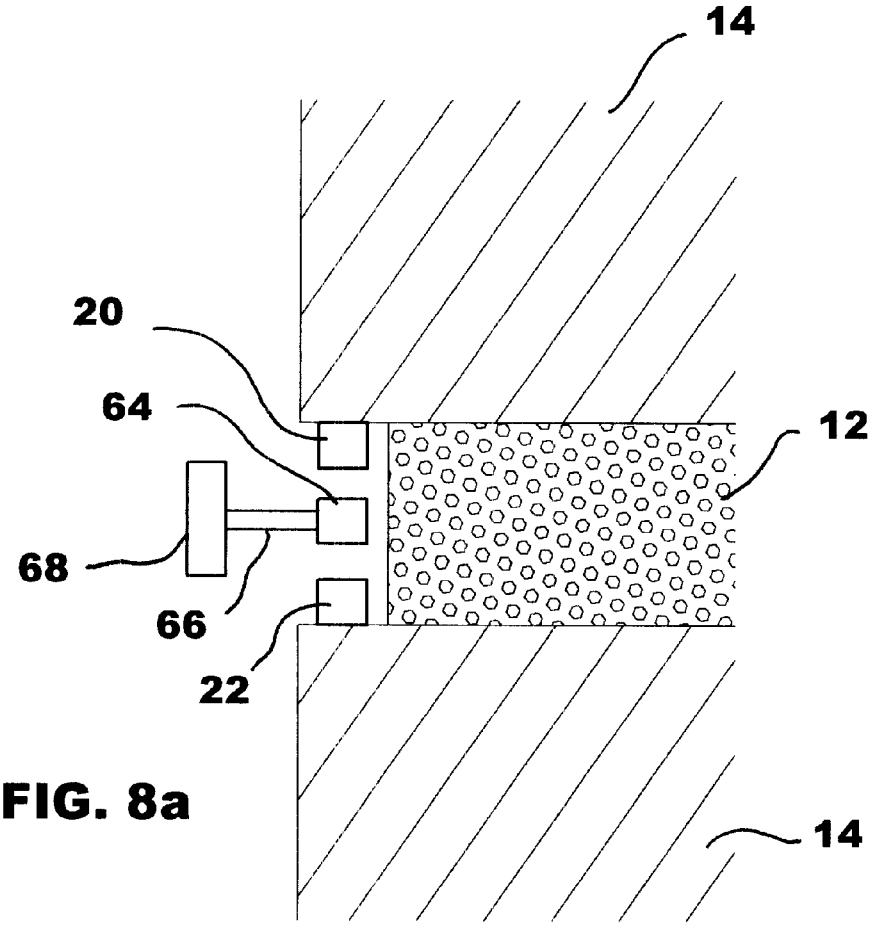
FIG. 8*a* is a side view of the fastening device of the present invention shown in FIGS. 6 and 7 and engaging a mortar joint between two bricks.

FIG. 8*a* is a side view of the fastening device 10 of the present invention shown in FIGS. 6 and 7 and engaging a mortar joint 12 between two bricks 14. To attach the fastening device 10 to a brick wall, the free ends of the first arm portion 20 and the second arm portion 22 are forced together, such that the clip member 16 is transformed from a relaxed state to a tensioned state and then the clip member 16 in the tensioned state is inserted within the mortar joint 12 between two adjacent bricks 14 such that the first and second arm portions 20 and 22 extend parallel to the bricks 14 and within the mortar joint 14, as shown in FIG. 8*a*. Then the first and second arm portions 20 and 22 are released such that the free ends of the first and second arm portions 20 and 22 engage the adjacent bricks 14. The cam member 64 is then inserted between the first and second arm portions 20 and 22 such that it is received within cavity 74 and the first and second arm portions 20 and 22 are further forced to engaged the bricks 14. The slot 70 allows for the cam member 64 to decrease in size and to be inserted into various sizes of mortar joints 12. The serrated surfaces 62 of the first and second arm portions 20 and 22 help grip the bricks 14. The desired object (not shown) is then hung on the rod member 66 and is prevented from being disengaged from the mounting member 18 by stop 68. The fastening device 10 can be used to support a variety of articles in the mortar joints 12 between bricks 14 and/or blocks. The cam member 64 can also be used alone to hold lighter objects. The cam member 64 may be sized and proportioned such that the cam member 64 may be placed within a mortar joint and rotated such that it engages the adjacent bricks and thus, is connected to the wall.

Figure 8B:
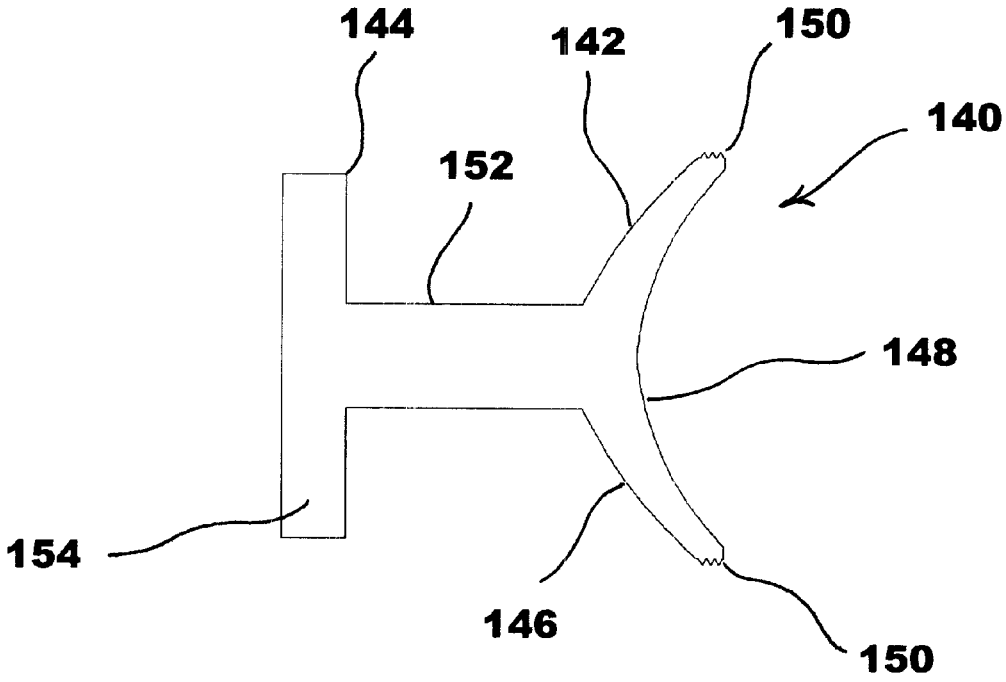
FIG. 8*b* is a side view of another embodiment of the fastening device of the present invention.
Figure 8C:
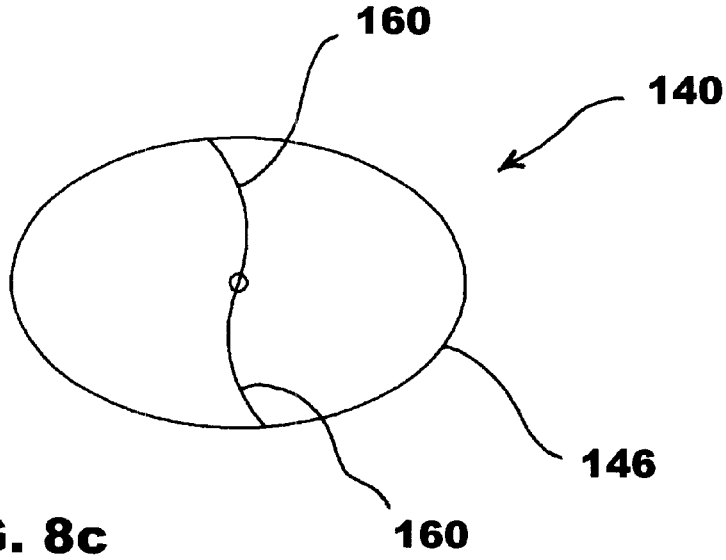
FIG. 8*c* is a front view of the cam member shown in FIG. 8*b;*

FIGS. 8*b* and 8*c* illustrate another embodiment of the fastening device 140 of the present invention comprising a cam member 142 and a mounting member 144. The cam member 142 has a cup portion 146 defining a recess 148 and having a plurality of thin flat threads 150 along the entire edge of the cup portion 146. The threads 150 may be straight or slightly angled. The cup portion 146 has a biasing mechanism; as can be seen in FIG. 8*c*, the cup portion 146 has a plurality of spring members 160 molded within the cup portion 146. The cross-section of the cup member 146 may be oblong; however, the cup portion 146 may also be a variety of other shapes. The spring members 160 may take the form of dense plastic such as, for example, polycarbonate, wherein once the cup portion is flexed or stretched the spring mechanism will return the cup portion to its original shape. The mounting member 144 comprises a rod member 152 and a stop 154, wherein the stop 154 may take any number of shapes and sizes depending on the size and shape of the object being attached to the grooved wall.

To attach the fastening device 140 to a grooved wall, the cup portion 146 is turned relative to the mortar joint (not shown) thus, by turning the cup portion 146 relative to the mortar joint, the cup portion 146 is screwed into the mortar joint. As the cup portion 146 is turned relative to the mortar joint the threads 150 bite into the adjacent bricks and thus grip the bricks. The spring members 160 bias the threads 150 against the bricks. Once attached to the grooved wall, an object can be mounted on the rod member 152.

Figure 8D:
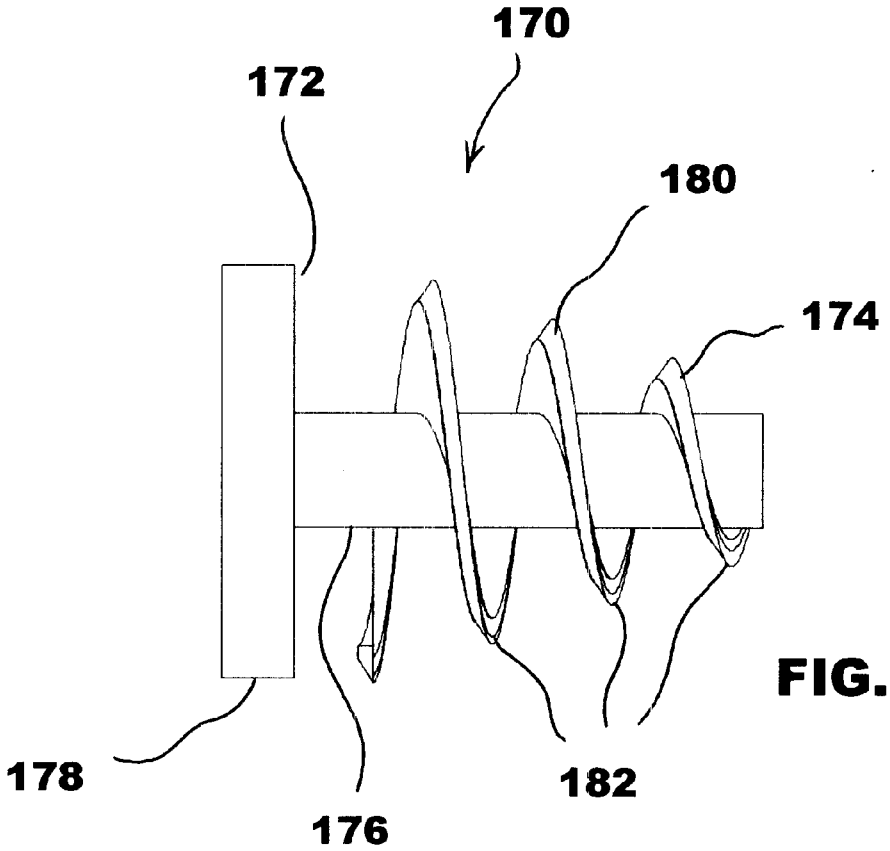
FIG. 8*d* is a side view of another embodiment of the fastening device of the present invention.
Figure 8E:
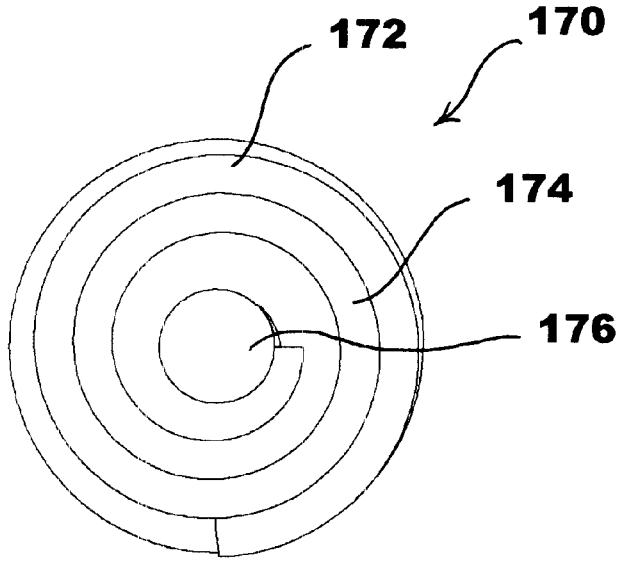
FIG.8*e* is a front view of the fastening device shown in FIG. 8*d*

FIGS. 8*d* and 8*e* illustrate another embodiment of the fastening device 170 of the present invention. The fastening device 170 comprises a mounting member 172 and an engagement portion 174. The mounting member 172 has a rod member 176 and a stop member 18 similar to the mounting member illustrated in FIG. 8*b* and described above. The engagement portion 174 comprises a flexible spiral portion 180 fixedly attached to the rod member 176. The spiral portion 180 radiates from the rod member 176. Although the spiral portion 180 is shown as having three turns 182 that are substantially circular in shape, the spiral portion 180 may be many shapes such as square, rectangular or oval. To attach the fastening device 170 to the grooved wall (not shown), the engagement portion 174 is inserted within the groove that may be a mortar joint between two adjacent bricks as shown in FIGS. 1 and 8*a*. The spiral portion 180 deforms such that it engages and is biased against the adjacent bricks. An object (also not shown) may then be attached to the mounting member 172. As with the other embodiments of the fastening device of the present invention, the fastening device may be made from plastic; however, suitable metals may also be used.

Figure 8F:
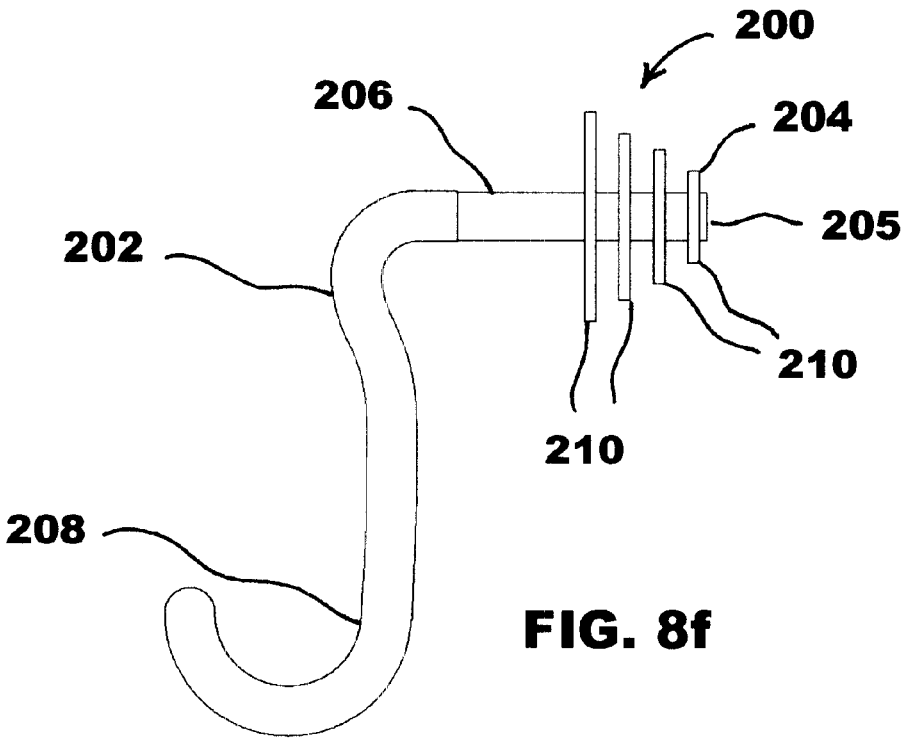
FIG. 8*f* is a side view of yet another embodiment of the fastening device of the present invention.
Figure 8G:
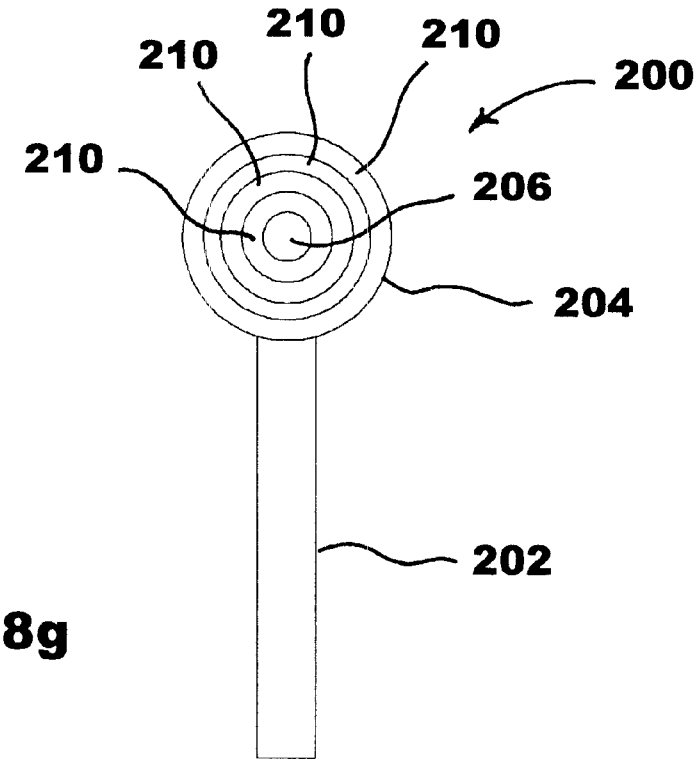
FIG. 8*g* is a front view of the fastening device shown in FIG. 8*f;*

FIGS. 8*f* and 8*g* illustrate yet another embodiment of the fastening device 200 of the present invention. The fastening device 200 comprises a mounting member 202 and an engagement portion 204. The mounting member 202 comprises a rod member 206 and a S-shaped hook member 208 that is spring-biased such that it may flex and grip an object (not shown). The S-shaped hook member 208 is similar to the hook member shown in FIG. 4. The engagement portion 204 comprises a several flexible circular portions 210 concentric with and spaced along the rod member 206. Although not illustrated the circular portions 210 may be a variety of shapes such as square, rectangular or oval and may also be positioned at various places along the rod member 206. Furthermore, the circular portions 210 do not have to be concentric with the rod member 206; the circular portions 210 may be off-center with respect to the rod member 206.

Figure 8H:
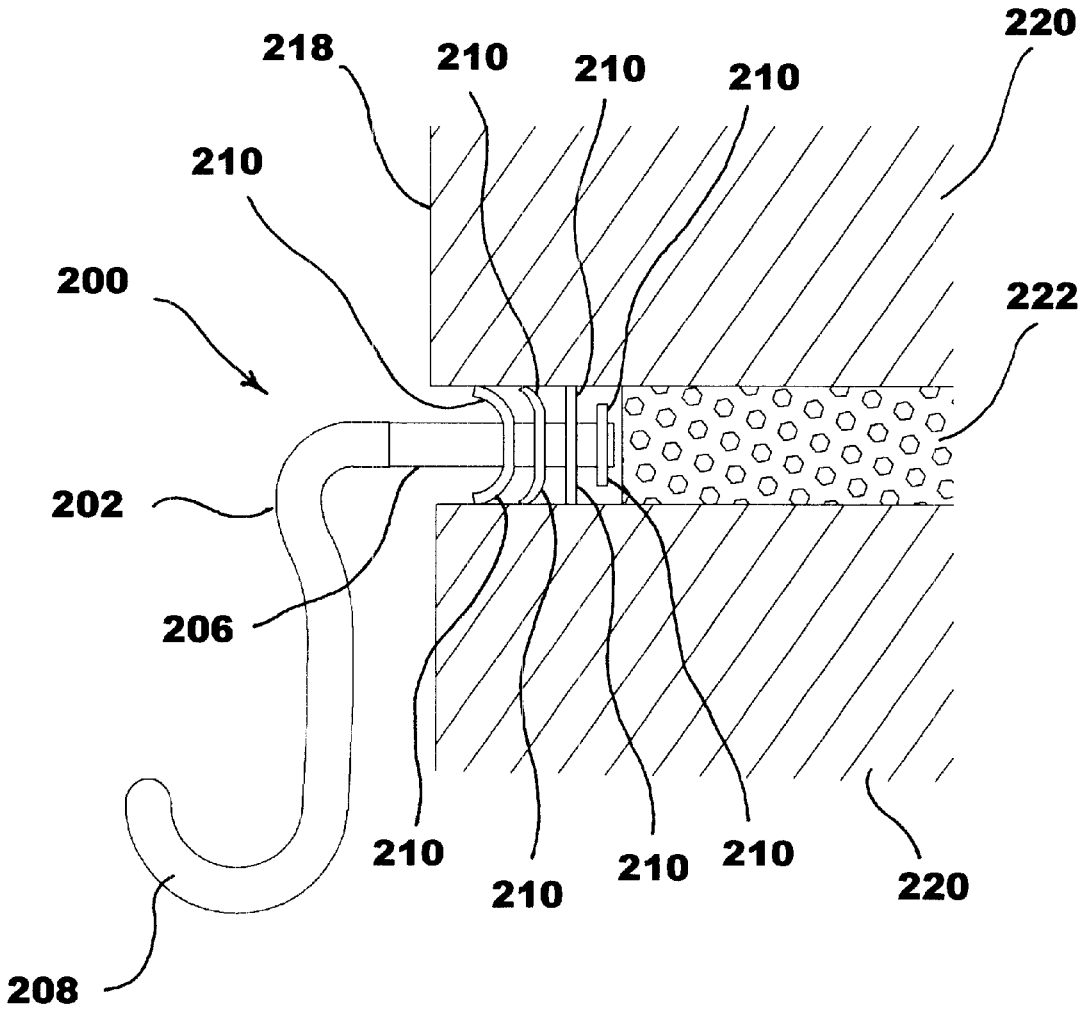
FIG. 8*h* is a side view of the fastening device shown in FIGS. 8*f* and 8*g* attached to a grooved wall.

FIG. 8*h* is a side view of the fastening device 200 shown in FIGS. 8*f* and 8*g* attached to a grooved wall 218 having adjacent bricks 220 and a mortar joint 222. To attach the fastening device 200 to the grooved wall 218, the engagement portion 204 is inserted within the groove between the bricks 220 as shown in FIG. 8*h* such that the circular portions 210 deform and thus, engage and are biased against the bricks 220 and are thereby attached to the grooved wall 218. Once the fastening device 200 is securely attached to the grooved wall 218, an object (not shown) may be mounted on the mounting device 202. If the groove of the wall between adjacent bricks is shallow, the user may snip off a portion of the end 205 of the rod member 206 with a pair of scissors or wire cutters such that the fastening device 200 better fit within the mortar joint. Depending on the depth of the groove of the mortar joint, the user may eliminate some of the circular portions 210 when the user snips off a portion of the end 205 of the rod member 206

Figure 9:
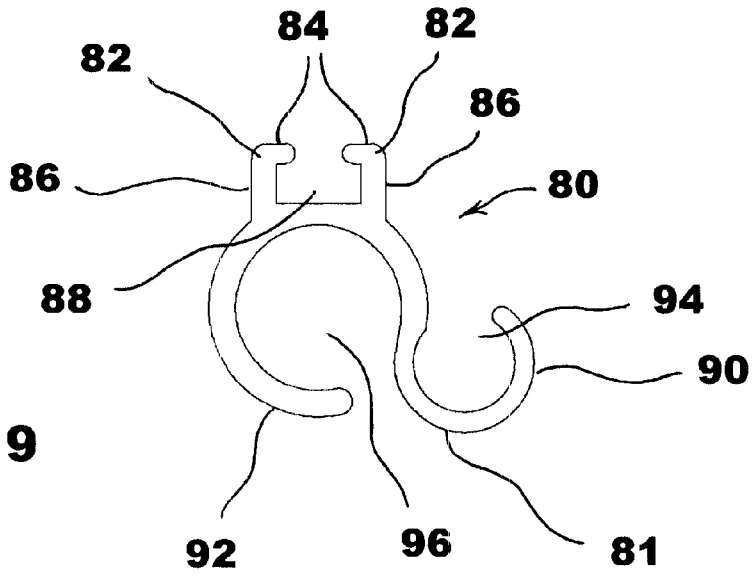
FIG. 9 is a side view of a second mounting member of the present invention that may be used with the fastening devices shown in FIGS. 1–5.

FIG. 9 is a side view of a second mounting member 80 of the present invention that may be used with the fastening devices 10 shown in FIGS. 1–5. The second mounting device 80 comprises an S-shaped body 81 having two leg members 82 fixedly connected thereto. Each of the two leg members 82 are L-shaped in that each of the two leg members 82 have a first portion 84 and a second portion 86.

The two leg members 82 define a cavity 88. The S-Shaped body 81 has a first curved portion 90 and a second curved portion 92 that are flexible. The first curved portion 90 defines a first recess 94 and the second curved portion 92 defines a second recess 96 wherein the first recess 94 and the second recess 96 may be a variety of sizes depending on object sizes. The second mounting member 80 may be plastic, however, suitable metals may be used.

The second mounting member 80 may be releasably connected to any one of the fastening members 10 shown in FIGS. 1–5 by, for example, using barbs. Although not shown, the second mounting member 80 may also be permanently attached to any of the fastening devices shown in FIGS. 1–5. The mounting member 18 of the fastening devices 10, shown in FIGS. 1–5, may be slideably received within the cavity 88. The leg members 82 are flexible such that they grip the hook member 28. The first curved portion 90 and the second curved portion 92 are also flexible such that they may grip various sized objects. The objects (not shown) may be received within the first and second recesses 94 and 96. The mounting member 18 and the second mounting member 80 may simultaneously support objects.

Figure 10:
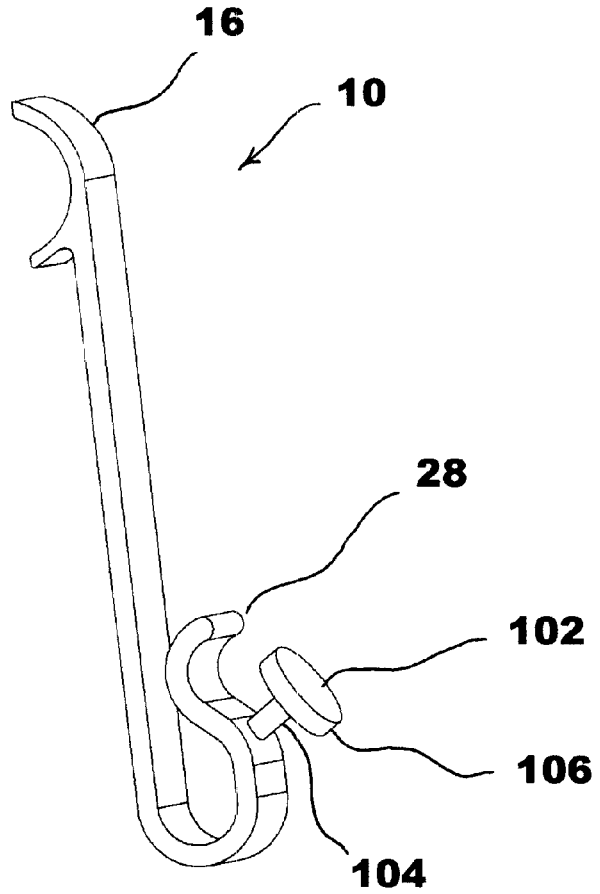
FIG. 10 is a perspective view of another embodiment of the fastening device of the present invention having a knob member.
Figure 11:
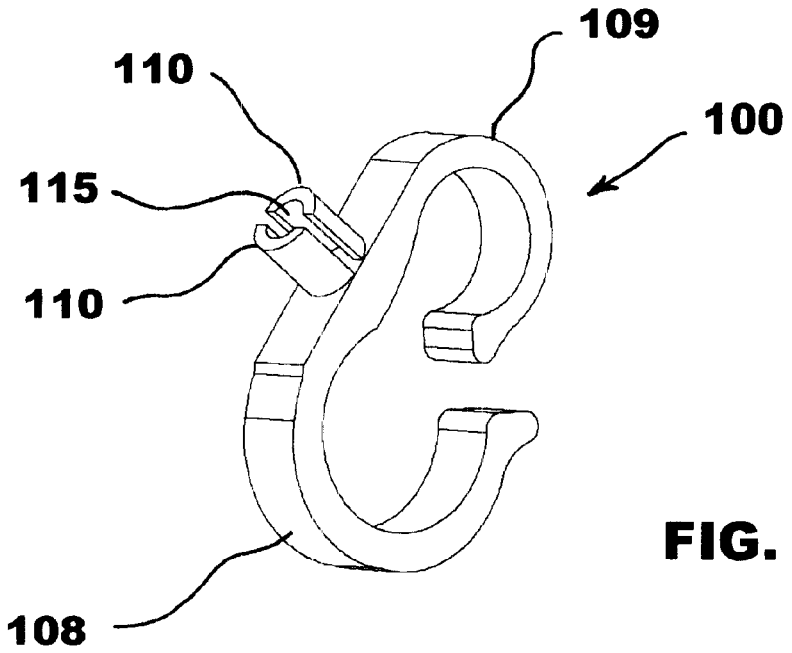
FIG. 11 is a perspective view of another embodiment of a second mounting member of the present invention that may be used with the fastening device shown in FIG. 10.
Figure 12:
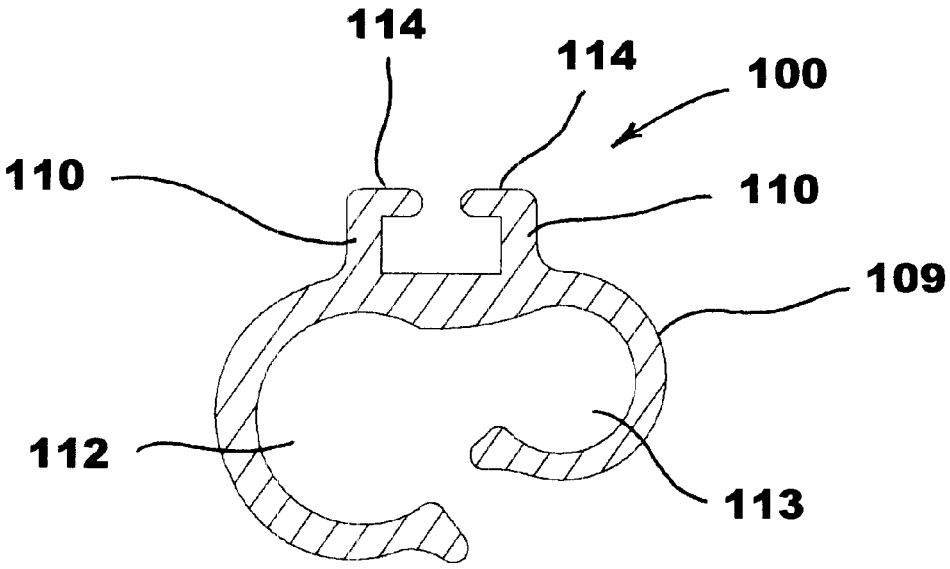
FIG. 12 is a sectional view of the second mounting member shown in FIG. 11.

FIG. 10 is a perspective view of another embodiment of the fastening device 10 of the present invention having a knob member 102 and FIGS. 11 and 12 are perspective and sectional views, respectively, of another embodiment of a second mounting member 100 of the present invention that may be used with the fastening device 10 shown in FIG. 10. The fastening device 10 comprises a clip member 16 and a mounting member 18 similar to that shown in FIG. 4 except that the mounting member 18 further includes a knob member 102 fixedly connected thereto. The knob member 102 has a rod member 104 and a bulbous portion 106 connected thereto.

Referring to FIGS. 11 and 12, the second mounting member 100 comprises two C-shaped members 108 and 109 and two semi-circular legs 110 fixedly connected to the second mounting member 100. The C-shaped member 108 defines recess 112 and the C-shaped member 109 defines recess 113, wherein the recesses 112 and 113 may be different sizes. The two semi-circular legs 110 each have an overhang portion 114 and define opening 115. The second mounting member 100 is flexible. In use, the fastening device 10 is attached to a wall (not shown) as described above. The knob member 102 is received within the opening 115 such that the second mounting member 100 is releasably attached to the fastening device 10. The flexible semi-circular legs 110 grip the knob member 108 and hold the second mounting member 100 in position with respect to the fastening device 10. Objects (not shown) may be received within the recesses 112 and 113 and gripped by the flexible C-shaped members 108 and 109.

Figure 13:
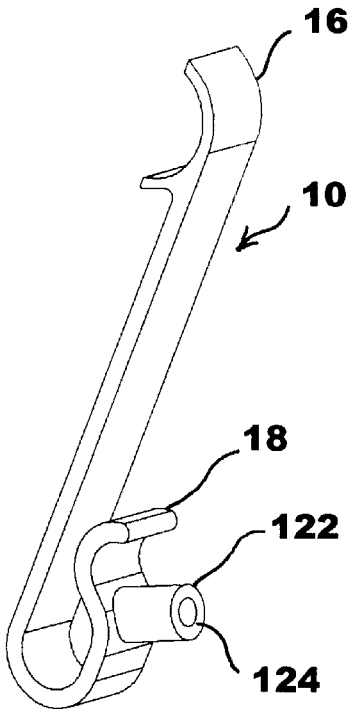
FIG. 13 is a perspective view of another embodiment of the fastening device of present invention.
Figure 13A:
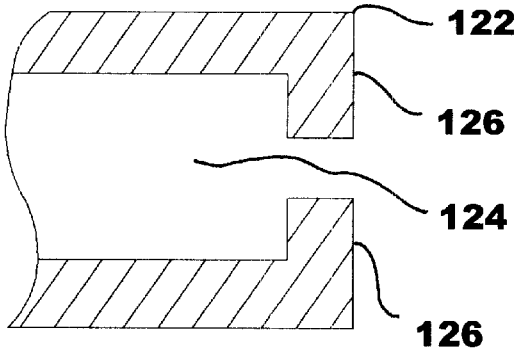
FIG. 13*a* is a sectional view of a portion of the tubular member of the fastening device shown in FIG. 13.

FIGS. 13 and 13*a* illustrate another embodiment of the fastening device 10 of present invention. The fastening device 10 comprises a clip member 16 and a mounting member 18 similar to that shown in FIG. 4 except that the mounting member 18 further includes a tubular member 122 fixedly connected thereto. The tubular member 122 defines a cavity 124 and has a circular overhang 126.

Figure 14:
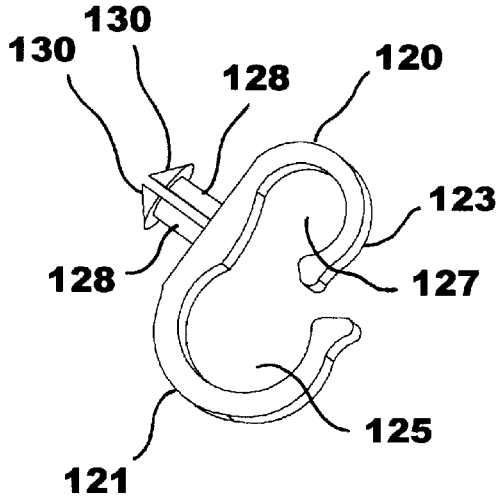
FIG. 14 is a perspective view of another embodiment of a second mounting member of the present invention that may be used with the fastening device shown in FIG. 13.

FIG. 14 illustrates another embodiment of a second mounting member 120 of the present invention that may be used with the fastening device 10 shown in FIG. 13. The mounting member 120 comprises two C-shaped members 121 and 123 similar to C-shaped members 108 and 109 described above and illustrated in FIGS. 11 and 12 except that the second mounting member 120 does not have semi-circular legs 110, but does comprise prongs 128 fixedly connected to the second mounting member 120. Each of the prongs 128 has a tang 130 on one end thereof. The second mounting member 120 is flexible and may be plastic, but may also be a suitable metal. After the fastening member 10 is attached to a wall (not shown), as described above, the prongs 128 are flexed towards one another and inserted into the cavity 124. Once released, the tangs 130 of the prongs 128 engage the overhang 126 of the tubular member 122 and fixedly connect the second mounting member 120 to the fastening device 10. The second mounting member 120 may receive objects (not shown) within recesses 125 and 127 such that the flexible C-shaped members 121 and 123 will grip the objects. As stated above, the second mounting member 120 and the fastening device 10 may simultaneously support and hold objects. Although not shown, the tubular members 122 may be eliminated and the mounting member 18 may have a hole therein that may receive the prongs 128.

Those of ordinary skill in the art will recognize, however, that many modifications and variations of the present invention may be implemented without departing from the spirit and scope of the present invention. The foregoing description and the following claims are intended to cover such modifications and variations.

What is claimed is:

1. A one-piece fastening device, comprising:

a clip member integrally comprising a first arm portion, a second arm portion and an intermediate portion, said first arm portion and said second arm portion each connected to said intermediate portion and each having a free end, said clip member being structured to have a biasing function such that said first arm portion and said second arm portion can move from a relaxed position to a tensioned position; and a mounting member integral to the clip member and integrally connected to and extending in a downward direction from said intermediate portion such that when an object is attached to said mounting member the weight of the object increases the friction between said free ends of said first arm portion and said second arm portion and a structure to which said device is attached.

2. The one-piece fastening device of claim 1, wherein said clip member is concave.

3. The one-piece fastening device of claim 1, wherein said fastening device is plastic.

4. The one-piece fastening device of claim 1, wherein the structure is a brick wall having a plurality of bricks and a plurality of mortar joints and said fastening device is recessed within one of the plurality of mortar joints such that said free ends engage at least one of the plurality of bricks.

5. The one-piece fastening device of claim 4, wherein said mounting device has a hook integral thereto.

6. The fastening device of claim 5, wherein said hook member has an elongated portion, said elongated portion is connected to said clip member at one end thereof and connected to said hook at the other end thereof, said elongated portion extends proximate to the face of the plurality of bricks.

7. The one-piece fastening device of claim 5, wherein said hook has an S-shaped portion that is spring-biased and integral thereto.

8. A one-piece fastening device, comprising:

a mounting member for supporting an object; and an engagement portion integral to the mounting member, wherein said engagement portion has two free ends and deforms and engages and is biased against a structure such that said fastening device is secured to the structure.

* * * * *

UNITED STATES PATENT AND TRADEMARK OFFICE

CERTIFICATE OF CORRECTION

PATENT NO. : 6,497,396 B1
DATED : December 24, 2002
INVENTOR(S) : William E. Adams It is certified that error appears in the above-identified patent and that said Letters Patent is hereby corrected as shown below:

Column 2,
Line 38, insert -- be -- after “will”.

Column 8,
Line 50, insert -- one-piece -- before “fastening”.

Signed and Sealed this

Sixth Day of May, 2003

JAMES E. ROGAN
*Director of the United States Patent and Trademark Office*